US008783245B2

(12) United States Patent
Saraf et al.

(10) Patent No.: US 8,783,245 B2
(45) Date of Patent: Jul. 22, 2014

(54) VENTILATION SYSTEM FOR A RANGE HOOD WITH EXHAUST AND RECIRCULATION OPTIONS

(75) Inventors: Aashish Saraf, Hyderabad (IN); Mark Davis Johnson, Louisville, KY (US); John Davis Philley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 720 days.

(21) Appl. No.: 12/949,866

(22) Filed: Nov. 19, 2010

(65) Prior Publication Data

US 2012/0125316 A1 May 24, 2012

(51) Int. Cl.
*F24C 15/20* (2006.01)

(52) U.S. Cl.
USPC ..... 126/299 D; 126/299 R

(58) Field of Classification Search
USPC ..... 126/299 D, 299 R
See application file for complete search history.

(56) References Cited

U.S. PATENT DOCUMENTS

| | | | | |
|---|---|---|---|---|
| 3,800,689 | A | 4/1974 | Brown | |
| 4,146,016 | A * | 3/1979 | Bowen et al. | 126/299 D |
| 4,160,440 | A * | 7/1979 | Barnickle | 126/110 R |
| 4,362,146 | A * | 12/1982 | Schuller | 126/504 |
| 4,373,509 | A | 2/1983 | Neitzel et al. | |
| 4,856,491 | A * | 8/1989 | Ferguson et al. | 126/77 |
| 6,201,225 | B1 * | 3/2001 | Lee | 219/757 |
| 7,098,432 | B2 * | 8/2006 | Rew et al. | 219/757 |
| 2009/0226853 | A1 * | 9/2009 | Dong et al. | 431/115 |
| 2012/0055460 | A1 * | 3/2012 | Lambertson | 126/299 D |

* cited by examiner

*Primary Examiner* — Kenneth Rinehart
*Assistant Examiner* — Gajanan M Prabhu
(74) *Attorney, Agent, or Firm* — Dority & Manning, P.A.

(57) ABSTRACT

A ventilation system for a range hood of a kitchen area is provided. More particularly, a kitchen ventilation system is provided that has both exhaust and recirculation options that are provided by internally contained features for directing the flow of air. The system can be installed as a modular unit as part of a new or existing range hood.

11 Claims, 7 Drawing Sheets

VENTILATION SYSTEM FOR A RANGE HOOD WITH EXHAUST AND RECIRCULATION OPTIONS

FIELD OF THE INVENTION

The present invention relates to a ventilation system for a range hood of a kitchen area. More particularly, the present invention provides a kitchen ventilation system having both exhaust and recirculation options that are provided by internally contained features for directing the flow of air.

BACKGROUND OF THE INVENTION

Range hoods for kitchen areas are used to provide for air flow across a range or cooking surface in order to remove heat and/or fumes. Typically, such hoods may include one or more fans within a duct placed over the range to receive air and fumes from the range and other parts of the kitchen area. The fan draws air up into the duct which in turn carries the fumes away from the range and draws more air across the cooking surface. Controls may be placed on the range hood, range, or both depending upon the features provided.

Building codes or guidelines may set forth a certain minimum amount of air that must be moved by the range hood during use of the range. Such amounts are typically based on maximum use scenarios that assume e.g., full heat output by the range and/or other cooking appliances that may be present in the kitchen. These requirements can operate to provide reasonable temperatures within the kitchen area while preventing an undesirable buildup of fumes—particularly smoke or haze—within the kitchen area.

However, depending upon e.g., the amount and nature of heat and fumes produced by the range or other kitchen appliances, it may be desirable to recirculate back into the kitchen all or some portion of the air drawn into the hood. For example, during operation where smoke or fumes are minimal, the recirculation of the air may be preferable to exhausting the same to the atmosphere. Exhausting air to the atmosphere from a kitchen area will draw additional air into the kitchen that eventually must come from outside the structure or dwelling containing the kitchen area. Air from the outside may need to be heated or cooled by an air-conditioning system depending e.g., upon outside air temperature, which in turn consumes additional energy and provides added expense. Accordingly, for certain cooking situations, recirculation of air into the kitchen may be very desirable.

Range hoods require installation and space for such installation. Certain conventional hoods have dampers or diverters, for directing the flow of air between exhaust or recirculation, that must be cut-in and/or installed as the range hood is being installed. For example, conventional range hoods may include dampers and diverters with mechanical linkages or other controls positioned throughout duct work that are installed as separate components along with the fan.

Accordingly, a ventilation system for a range hood that provides for both removal or recirculation of air from a kitchen area would be useful. More particularly, such a ventilation system that can be provided within a single unit that can be readily installed in a range hood would be particularly beneficial. Such a system that can be provided with manual or motor driven controls would also be beneficial.

BRIEF DESCRIPTION OF THE INVENTION

Aspects and advantages of the invention will be set forth in part in the following description, or may be obvious from the description, or may be learned through practice of the invention.

In one exemplary embodiment of the present invention, a ventilation unit for a range hood is provided. The ventilation unit includes a housing with a top panel and a bottom panel. The top panel defines an exhaust vent for removing air from a kitchen area. The housing also defines a recirculation vent for recirculating air to the kitchen area and an intake for receipt of air from the kitchen area.

A fan is contained within the housing between the top and bottom panels. The fan is configured for pulling air into the intake of the housing and blowing the air through the housing between the top and bottom panels for exit through either the exhaust vent or the recirculation vent.

A damper is contained within the housing between the top and bottom panels. The damper is configured for selective rotation between i) a first position that prevents the flow of air through the exhaust vent while allowing air to flow through the recirculation vent and ii) a second position that allows air to flow through the exhaust vent while blocking the flow of air through the recirculation vent.

In another exemplary embodiment, the present invention also includes a range hood having a ventilation unit as set forth above and further described in more detail below.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
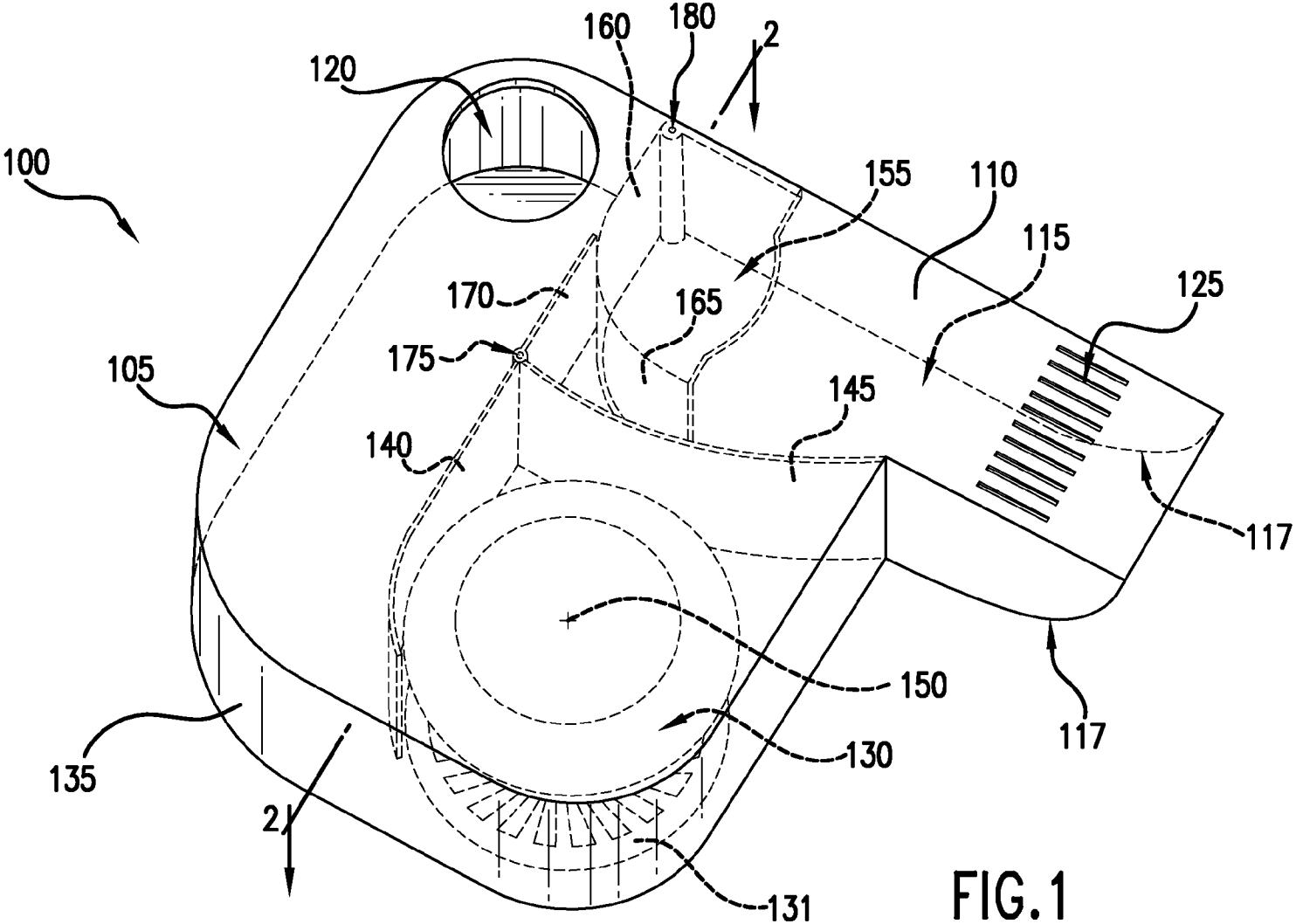
FIG. 1 is a perspective view of an exemplary embodiment of a ventilation unit according to the present invention with internal or non-visible features shown in dashed lines.

The present invention provides a ventilation system for a range hood of a kitchen area. More particularly, the present invention provides a kitchen ventilation system having both exhaust and recirculation options. Dampers and/or other features for channeling air flow between exhaust or recirculation are integrated within a single unit that can be connected within the duct of a range hood. Manual or motor driven controls may be provided.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
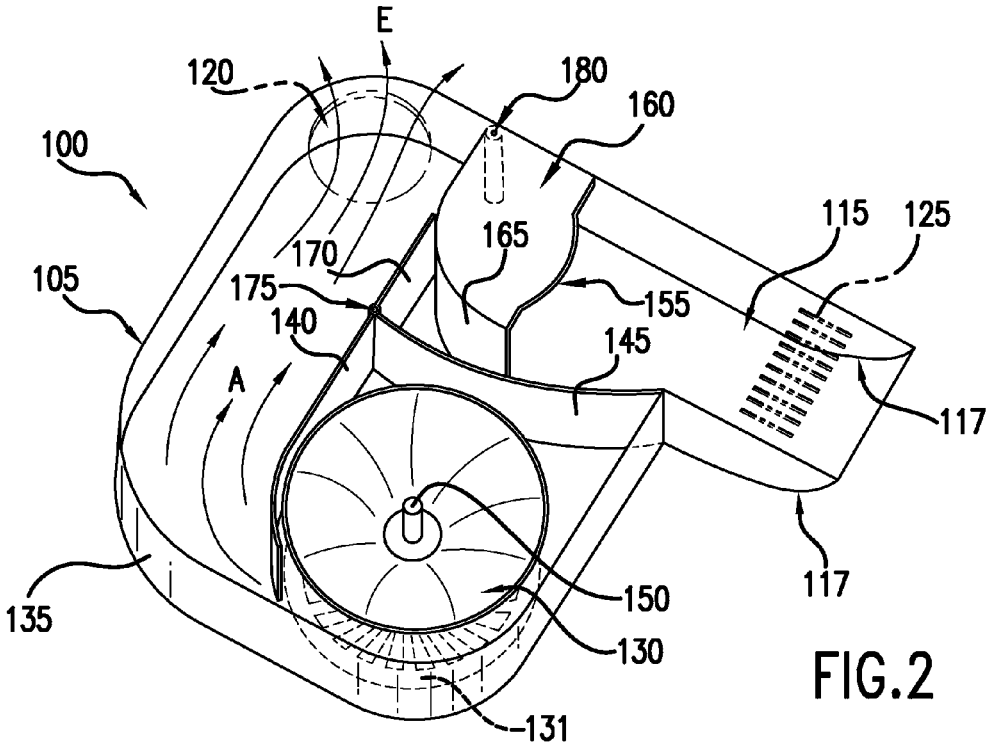
FIG. 2 is a perspective view of the exemplary embodiment of FIG. 1 operating to route air through an exhaust vent. The top panel has been removed for additional clarity.
Figure 3:
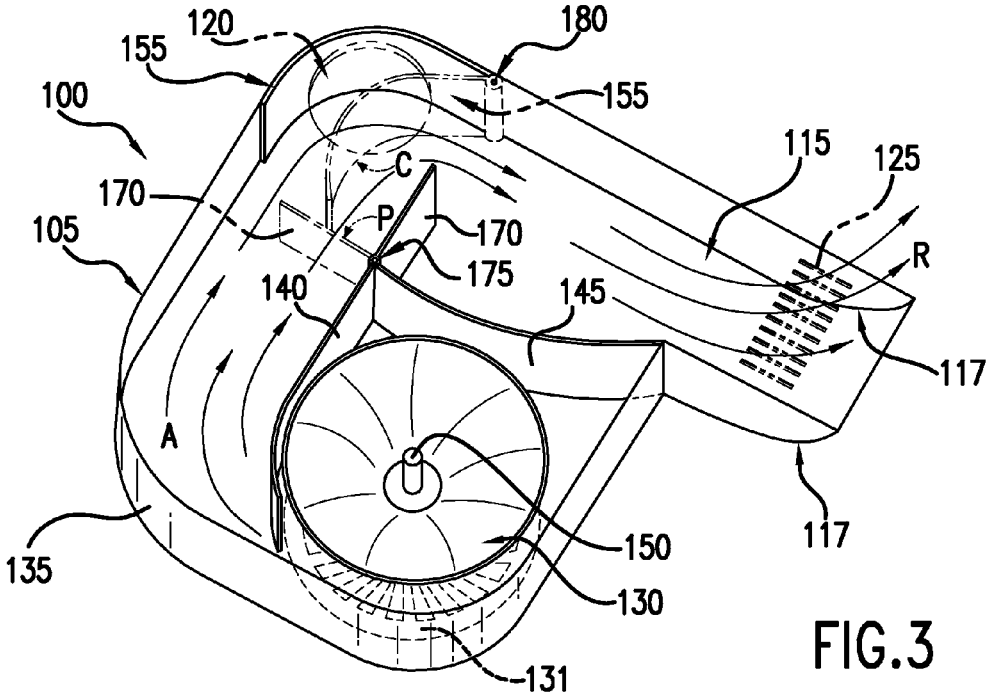
FIG. 3 is a perspective view of the exemplary embodiment of FIG. 1 operating to route air through a recirculation vent. The top panel and a portion of the damper have been removed for additional clarity.

An exemplary embodiment of a ventilation unit 100 for a range hood is shown in FIGS. 1 through 3. FIG. 1 provides a perspective view with certain internal and hidden feature shown in dotted lines. Ventilation unit 100 includes a housing 105 that is constructed from a top panel 110 and a bottom panel 115 that are substantially parallel (except for curved portion 117) and are connected at their respective peripheries by an external wall 135. Using the teachings disclosed herein, it will be understood by one of skill in the art that the present invention is not limited to the shape shown in FIG. 1 and other shapes for unit 100 may be used as well.

Top panel 110 defines an exhaust vent 120 for the flow of air out of housing 105 and into a range hood such as e.g., a duct connected to the exterior of the building or other structure associated with the kitchen area being ventilated. The top panel of housing 105 also defines a recirculation vent 125 for the flow of air out of housing 105 and back into e.g., the kitchen area. Recirculation vent 125, constructed as a series of slots, may be connected directly to the kitchen area or may feed into a duct or channel that in turn feeds into the kitchen area. A curved portion 117 of the bottom panel 115 assists in directing the flow of air within housing 105 through recirculation vent 125. FIG. 1 provides only an example of recirculation vent 125, other locations and configurations of recirculation vent 125 relative to housing 105 may also be used as well.

A fan 130 is also contained within housing 105 between top panel 110 and bottom panel 115. Fan 130 draws air from the kitchen area and into housing 105 through a fan guard 131 located in bottom panel 115. As shown by arrows A in FIGS. 2 and 3, fan 130 blows the air through housing 105 for passage out of housing 105 as either exhaust (arrows E) through exhaust vent 120 or as recirculated air (arrows R) through recirculation vent 125. Fan 130 is surrounded by fan wails 140 and 145 along with external wall 135, which help channel the flow of air through housing 105 and toward either exhaust vent 120 or recirculation vent 125 as further described below. As shown in all figures, fan 130 is of a centrifugal type with an axis of rotation 150 that is orthogonal to top panel 110 such that the flow of air within housing 105 is parallel to top panel 110. However, a variety of different constructions for fan 130 may be used including, for example, centrifugal types such as squirrel cage, forward curved, or backward curved and other types as well. Controls for operating fan 130 may be located with housing 105, the range hood, range, or a combination thereof as desired.

Ventilation unit 100 also includes a damper 155, an exemplary embodiment of which is shown in FIGS. 1 through 3. In FIGS. 2 and 3, top panel 110 has been removed for further clarity. As shown in FIGS. 1 and 2, damper 155 includes a top wall 160 that is parallel to top panel 110 and is shaped to cover exhaust vent 120 when damper 155 is in the position as shown in FIG. 3. For clarity, top wall 160 has been removed in FIG. 3 to show the movement of damper 155 into a first position by arrow C. More specifically, FIG. 3 illustrates damper 155 in a first position that prevents the flow of air through the exhaust vent 120 while allowing air to flow through the recirculation vent 125 as shown by arrows R.

Alternatively, FIG. 2. illustrates damper 155 in a second position that allows air to flow through exhaust vent 120 while blocking the flow of air through recirculation vent 125. As shown in FIG. 2, damper 155 includes a diverter wall 165 that is substantially orthogonal to top panel 110, carries top wall 160, and serves to assist in blocking the flow air through recirculation vent 125 when in this second position. As shown by arrow C in FIG. 3, damper 155 with diverter wall 165 and top wall 160 all rotate about pivot point 180 for placement in either the first position (FIG. 3) or the second position (FIG. 2) depending upon whether recirculation or exhaust is selected. For this exemplary embodiment of unit 100, damper 155 also includes a pivotal flap 170 that pivots about pivot point 175 (arrow P in FIG. 3) as damper 155 is moved between the first and second positions. Together, when in the second position shown in FIG. 2, diverter wall 165 and pivotal flap 170 contact each other and cooperate to prevent the flow of air through recirculation vent 125.

The movement of damper 155 between the first and second positions can be facilitated by one or more motors i.e., servos (not shown) mechanically connected with diverter wall 165 and/or pivotal flap 170. Such motor(s) may then be controlled from the range, range hood, or a combination thereof by e.g., switches located for the convenience of the user. Alternatively, damper 155 can be provided with manual controls such as e.g., levers or pins projecting through housing 105 for movement by the user so as to control the position of diverter wall 165 and pivotal flap 170.

Figure 4:
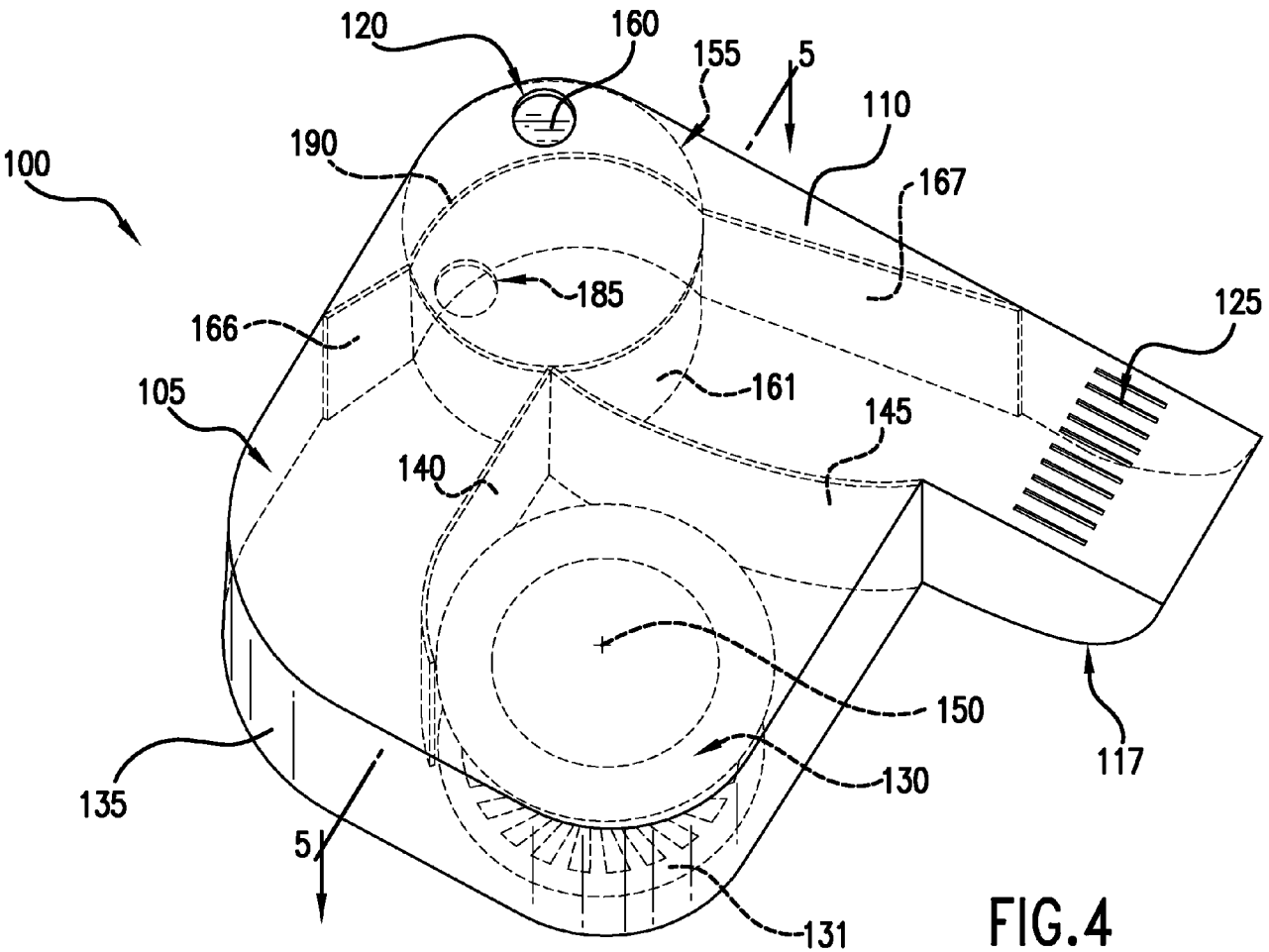
FIG. 4 is a perspective view of another exemplary embodiment of a ventilation unit according to the present invention with internal or non-visible features shown in dashed lines.
Figure 5:
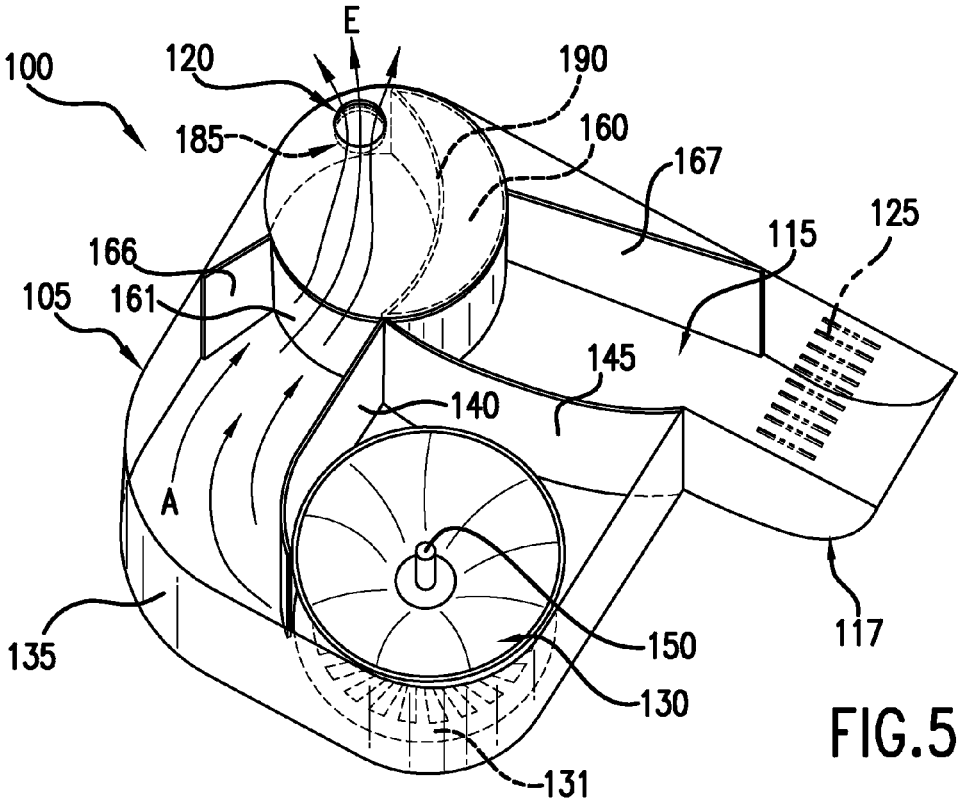
FIG. 5 is a perspective view of the exemplary embodiment of FIG. 4 operating to route air through an exhaust vent. The top panel has been removed for additional clarity.
Figure 6:
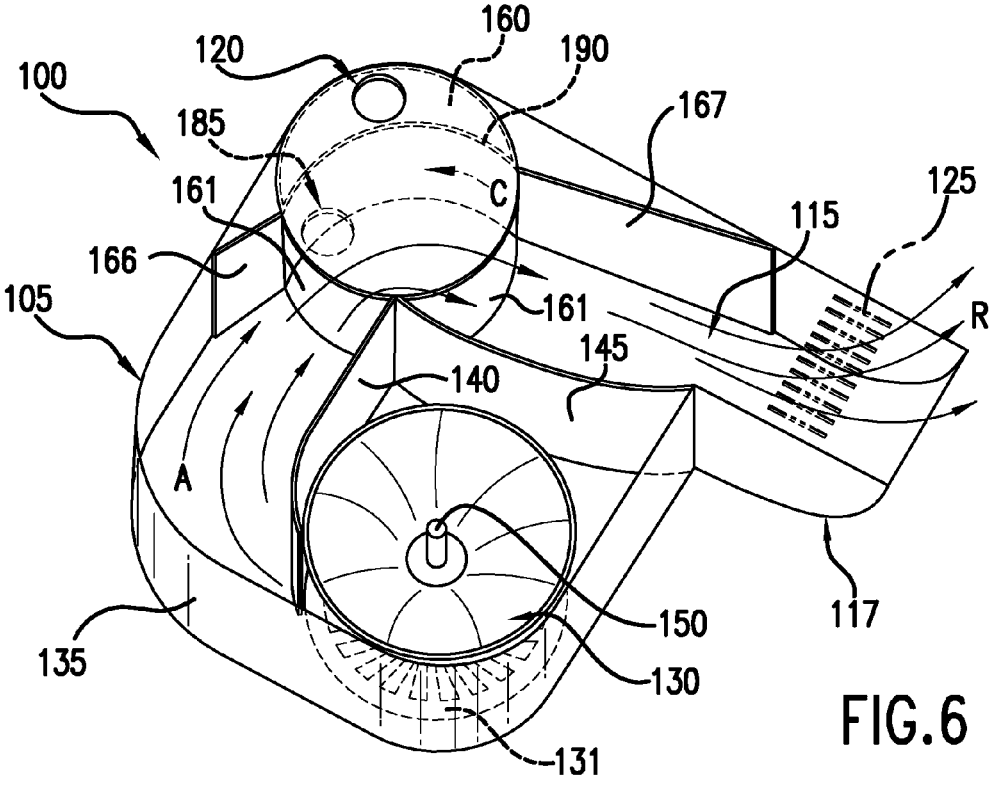
FIG. 6 is a perspective view of the exemplary embodiment of FIG. 4 operating to route air through a recirculation vent. The top panel has been removed for additional clarity.

FIGS. 4 through 6 illustrate another exemplary embodiment of a ventilation unit 100 of the present invention. The construction of unit 100 is similar to that shown in FIGS. 1 though 3 except for the structure and operation of a crescent-shaped damper 155. More particularly, as shown in FIGS. 4 through 6, damper 155 includes a top wall 160 that is substantially parallel and coplanar to top panel 110 of housing 105. Top wall 160 defines an aperture 185. Damper 155 also includes an arcuate-shaped diverter 190 that is substantially orthogonal to top panel 110 and extends between bottom wall 161 and top wall 160. Bottom wall 161 is substantially parallel and coplanar to bottom panel 115. Top wall 160, bottom wall 161, and diverter 190 all move together during rotation of damper 155 as indicated by arrow C in FIG. 6.

Accordingly, for the exemplary embodiment of FIGS. 4 through 6, air drawn into housing 105 by fan 130 is recirculated into the kitchen area (arrows R) through recirculation vent 125 when damper 155 is placed into a first position as shown in FIG. 6. In this first position, aperture 185 of top wall 160 is not aligned with exhaust vent 120 defined by top panel 110 of housing 105. Instead, exhaust vent 120 is blocked in this first position by top wall 160 of damper 155. Thus, as air flows through housing 105 as shown by arrows A, the air is re-directed towards recirculation vent 125 as it contacts arcuate-shaped diverter 190. Diverter walls 166 and 167 assist in this re-direction of air flow towards recirculation vent 125.

Alternatively, by rotating damper 155 into the second position shown in FIG. 5, aperture 185 is now aligned with exhaust vent 120 in top panel 110. Accordingly, air drawn into housing 105 by fan 130 is directed outwardly through exhaust vent 120 (arrows E) where it may travel into e.g., a duct in the range hood to the exterior of the building. In this second position, arcuate-shaped diverter of damper 155 blocks the flow of air through the recirculation vent 125. As with the embodiment of FIGS. 1 through 3, the rotation of damper 155 may be provided by manual or motor driven operation.

Figure 7:
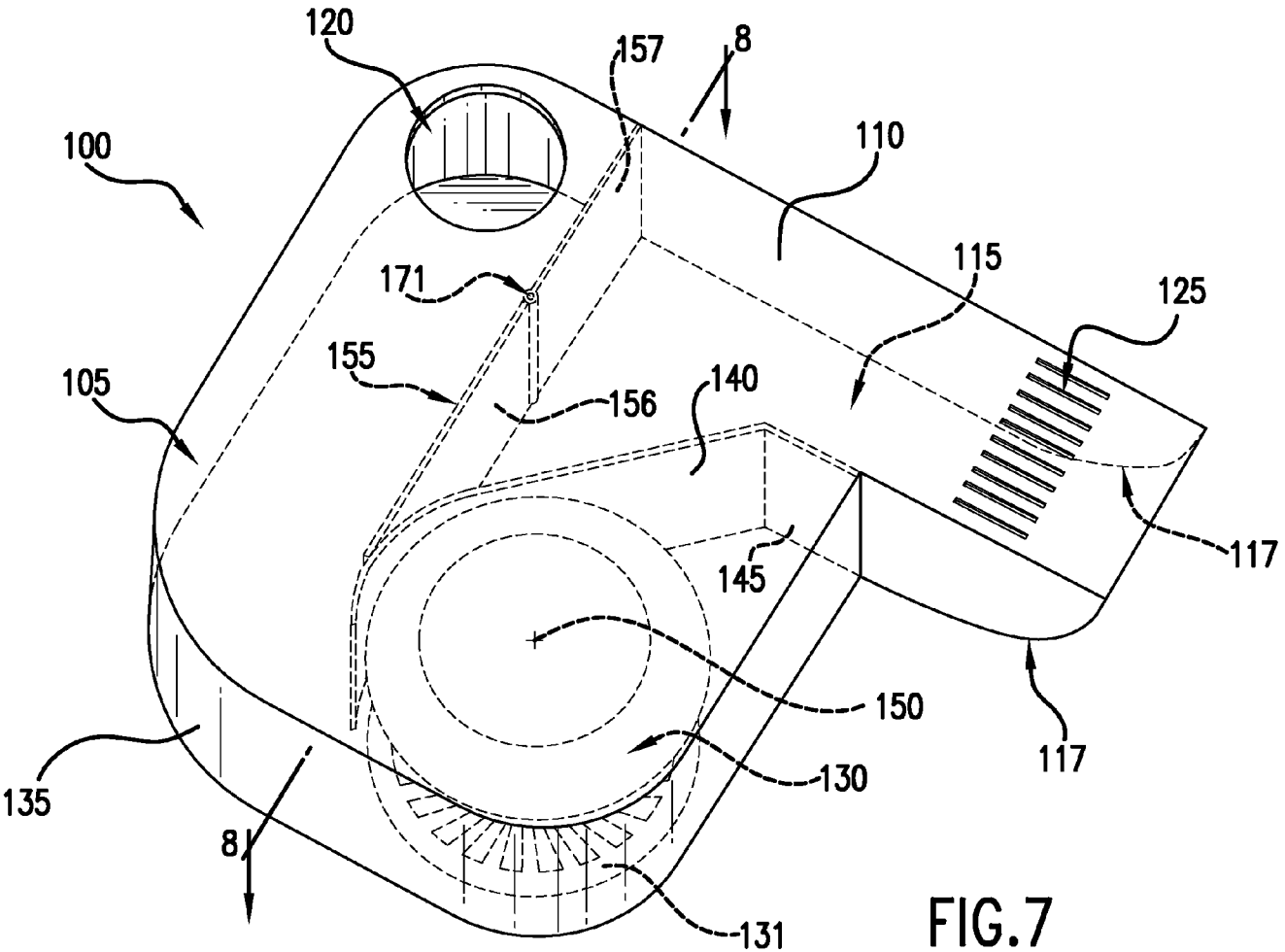
FIG. 7 is a perspective view of another exemplary embodiment of a ventilation unit according to the present invention with internal or non-visible features shown in dashed lines.
Figure 8:
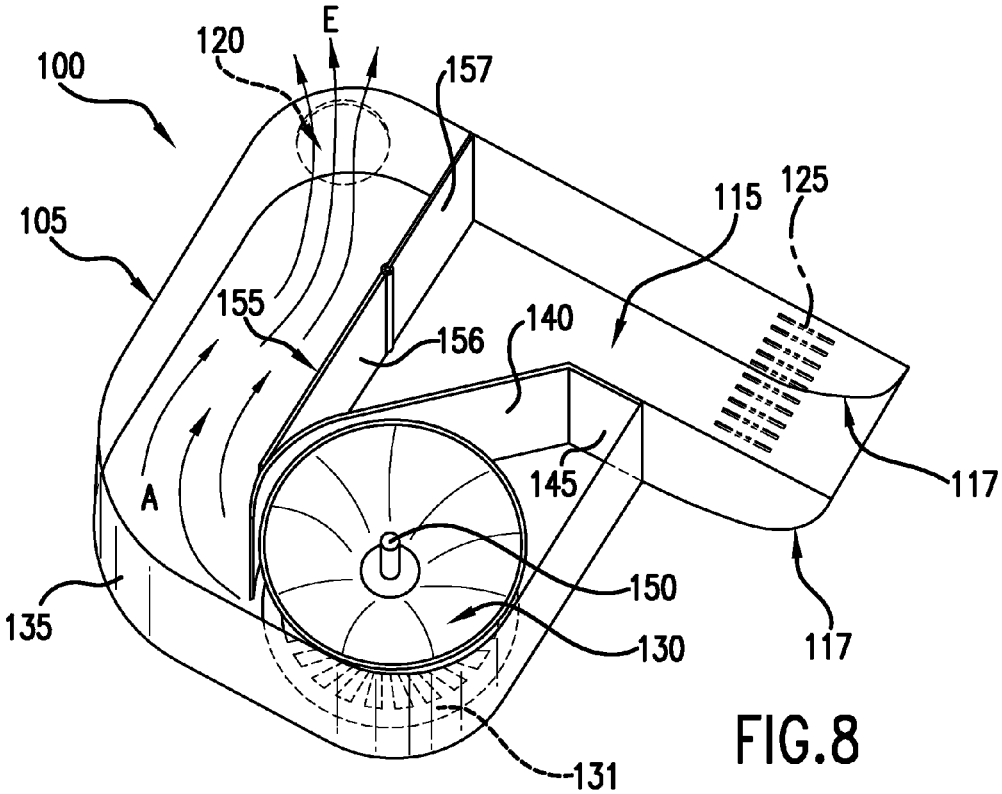
FIG. 8 is a perspective view of the exemplary embodiment of FIG. 7 operating to route air through an exhaust vent. The top panel has been removed for additional clarity.
Figure 9:
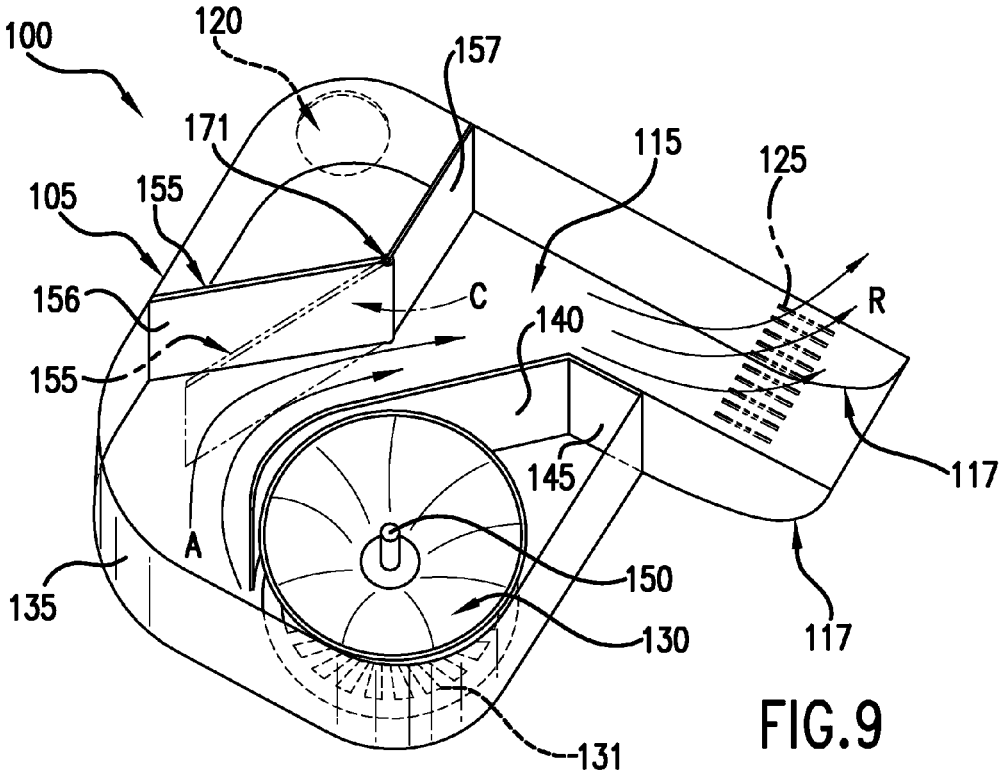
FIG. 9 is a perspective view of the exemplary embodiment of FIG. 7 operating to route air through a recirculation vent. The top panel has been removed for additional clarity.

FIGS. 7 through 9 illustrate another exemplary embodiment of a ventilation unit 100 of the present invention. The construction of unit 100 is similar to that of previous embodiments except for damper 155. More particularly, for this exemplary embodiment, damper 155 includes a movable wall 156 that is substantially orthogonal to top panel 110 and is connected in a hinge-like manner at pivot point 171 to a non-movable wall 157, which extends into housing 110 from external wall 135. As shown by arrow C, movable wall 156 is rotatable between a first position shown in FIG. 9 and a second position shown in FIG. 8. In the first position of damper 155 as shown in FIG. 9, movable wall 156 and non-movable wall 157 prevent the flow of air through exhaust vent 120 and help direct the flow of air through recirculation vent 125 as shown by arrows R. In the second position of damper 155 as illustrated in FIG. 8, movable wall 156 and non-movable wall 157 allow air to flow through exhaust vent 120 (arrows E in FIG. 8) while blocking the flow of air through recirculation vent 125. As with the previously described embodiments, the rotation of damper 155 may be provided by manual or motor driven operation.

As will be understood from the previously described embodiments, the damper 155 for selecting between exhaust and recirculation of air from the kitchen area is contained within ventilation unit 100. By having this feature self-contained within housing 105, unit 100 can be readily installed into a new or existing range hood without the necessity of complex linkages extending through the duct work of the range hood. Instead, damper 155 is installed as a unit 100 with fan 130. Furthermore, the user is provided with a convenient system for readily switching between exhaust or recirculation. If desired, the user can also place damper 155 at intermediate positions whereby the air flowing out of unit 100 is divided between exhaust vent 120 and recirculation vent 125.

Figure 10:
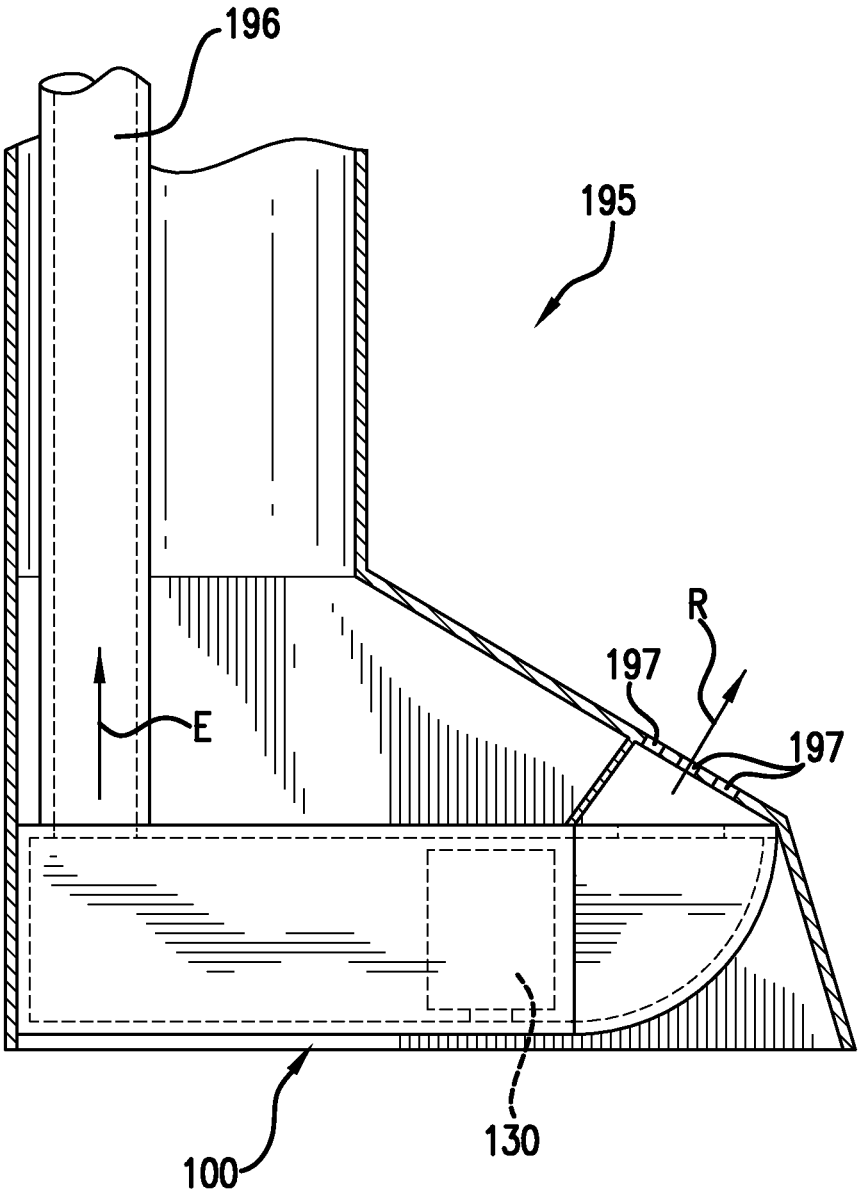
FIG. 10 is a sectional view of a range hood incorporating a ventilation system in an exemplary embodiment of the present invention.

FIG. 10 provides an example of a unit 100 installed within a range hood 195. Unit 100 is connected to duct 196 for exhausting fumes and air to the exterior as indicated by arrow E. Alternatively, vent opening 197 allows for recirculation into the kitchen area as indicated by arrow R. Hood 195 is provided by way of example only. Other configurations of hood 195 and its combination with unit 100 may be applied as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A ventilation unit for a range hood, comprising:

a housing comprising a top panel and a bottom panel, the top panel defining an exhaust vent for removing air from a kitchen area, said housing also defining a recirculation vent for recirculating air to the kitchen area, said housing also defining an intake for receipt of air from the kitchen area;

a fan contained within said housing between the top and bottom panels, said fan configured for pulling air into the intake of said housing and blowing the air through said housing and between the top and bottom panels for exit through either the exhaust vent or the recirculation vent;

a damper contained within said housing between the top and bottom panels, said damper comprising a top wall that is substantially parallel to the top panel and is configured to cover the exhaust vent when said damper is in a first position;

a diverter wall that is substantially orthogonal to the top panel and is configured to block the flow of air through the recirculation vent when said damper is in a second position;

wherein said damper configured for selective rotation between i) the first position that prevents the flow of air through the exhaust vent while allowing air to flow through the recirculation vent and ii) the second position that allows air to flow through the exhaust vent while blocking the flow of air through the recirculation vent; and a pivotal flap that is substantially orthogonal to the top panel and is configured for pivoting as said damper moves between the first and second positions, said pivotal flap also configured to contact the diverter wall of said damper so as to assist in blocking the flow of air when said damper is in the second position.

2. A ventilation unit for a range hood as in claim 1, further comprising a motor connected with said damper and configured for moving said damper between the first position and the second position.

3. A ventilation unit for a range hood as in claim 1, wherein said fan comprises a centrifugal fan having an axis of rotation that is substantially orthogonal to the top panel such that the direction of air flow within said housing is substantially parallel to the top panel.

4. A ventilation unit for a range hood as in claim 1, wherein said top panel and said bottom panel are substantially parallel to one another.

5. A ventilation unit for a range hood as in claim 1, wherein said recirculation vent is defined by the top panel.

6. A ventilation unit for a range hood as in claim 5, wherein the intake is defined by the bottom panel.

7. A ventilation unit for a range hood as in claim 1, wherein said damper is connected in a hinge-like manner along one end so that said damper may be rotated between the first and second positions.

8. A ventilation unit for a range hood as in claim 1, wherein the top and bottom panels of said housing are attached along respective edges by an external wall extending around said housing.

9. A range hood comprising the ventilation unit of claim 1.

10. A ventilation unit for a range hood, comprising:

a housing comprising a top panel and a bottom panel, the top panel defining an exhaust vent for removing air from a kitchen area, said housing also defining a recirculation vent for recirculating air to the kitchen area, said housing also defining an intake for receipt of air from the kitchen area;

a fan contained within said housing between the top and bottom panels, said fan configured for pulling air into the intake of said housing and blowing the air through said housing and between the top and bottom panels for exit through either the exhaust vent or the recirculation vent;

a damper positioned in said housing between the top and bottom panels and movable between i) a first position that blocks the flow of air through the exhaust vent while allowing air to flow through the recirculation vent and ii) a second position that allows air to flow through the exhaust vent while blocking the flow of air through the recirculation vent, said damper comprising a top wall that is substantially parallel to the top panel and covers the exhaust vent when said damper is in a first position;

a diverter wall that is substantially orthogonal to the top panel and blocks the flow of air through the recirculation vent when said damper is in a second position; and a pivotal flap that is substantially orthogonal to the top panel and is configured for pivoting as said damper moves between the first and second positions, said pivotal flap also configured to contact the diverter wall of said damper so as to assist in blocking the flow of air when said damper is in the second position.

11. A range hood comprising the ventilation unit of claim 10.

* * * * *